US009227113B2

(12) United States Patent
Mace et al.

(10) Patent No.: US 9,227,113 B2
(45) Date of Patent: Jan. 5, 2016

(54) BADMINTON RACKET

(71) Applicant: BABOLAT VS, Lyons (FR)

(72) Inventors: Catherine Mace, Lyons (FR); Nicolas Sene, Chaponost (FR); Gregoire Laverty, Lyons (FR)

(73) Assignee: BABOLAT VS, Lyons (FR)

( * ) Notice: Subject to any disclaimer, the term of this patent is extended or adjusted under 35 U.S.C. 154(b) by 0 days.

(21) Appl. No.: 14/043,977

(22) Filed: Oct. 2, 2013

(65) Prior Publication Data

US 2014/0100063 A1 Apr. 10, 2014

(30) Foreign Application Priority Data

Oct. 4, 2012 (FR) ..... 12 59443

(51) Int. Cl.

| | |
|---|---|
| ***A63B 49/02*** | (2015.01) |
| ***A63B 59/00*** | (2015.01) |
| ***A63B 49/06*** | (2006.01) |
| *A63B 67/18* | (2006.01) |

(52) U.S. Cl.

CPC ..... *A63B 49/02* (2013.01); *A63B 49/06* (2013.01); *A63B 59/0088* (2013.01); *A63B 67/18* (2013.01); *A63B 2059/0081* (2013.01)

(58) Field of Classification Search

CPC ..... A63B 49/00; A63B 49/02; A63B 49/027; A63B 49/10; A63B 49/06; A63B 67/18; A63B 59/0088; A63B 2059/0081

USPC ..... 473/524, 535, 536, 537, 546, 547

See application file for complete search history.

(56) References Cited

U.S. PATENT DOCUMENTS

| | | | | |
|---|---|---|---|---|
| 4,360,202 | A * | 11/1982 | Lo | 473/535 |
| 5,538,243 | A * | 7/1996 | Yamamoto et al. | 473/537 |
| 5,935,028 | A * | 8/1999 | Lo | 473/544 |
| 6,113,508 | A * | 9/2000 | Locarno et al. | 473/516 |
| 6,257,997 | B1 * | 7/2001 | Doble et al. | 473/516 |
| 6,416,432 | B1 * | 7/2002 | Rosen et al. | 473/524 |
| 7,140,398 | B2 * | 11/2006 | Dodge et al. | 138/177 |
| 7,211,010 | B2 * | 5/2007 | Lin et al. | 473/546 |
| 7,726,346 | B2 * | 6/2010 | Doble et al. | 138/177 |
| 2003/0144071 | A1 * | 7/2003 | Dodge et al. | 473/316 |
| 2006/0122013 | A1 * | 6/2006 | Dodge et al. | 473/516 |
| 2006/0199680 | A1 * | 9/2006 | Schwenger | 473/524 |
| 2007/0249438 | A1 | 10/2007 | Vacek et al. | |
| 2009/0215557 | A1 * | 8/2009 | Sokol et al. | 473/524 |

OTHER PUBLICATIONS

French Search Report dated Mar. 26, 2013, corresponding to the Foreign Priority Application No. 1259443.

* cited by examiner

*Primary Examiner* — Raleigh W Chiu
(74) *Attorney, Agent, or Firm* — Young & Thompson

(57) ABSTRACT

The badminton racket (1) includes a frame (2), a handle (4) and a shaft (6) connecting the frame to the handle. It defines a first direction ($D_1$) parallel to a longitudinal axis ($X_1$) of the shaft, a second direction ($D_2$) perpendicular to the first direction and parallel to a plane ($P_8$) in which strings (8) extend mounted in the frame (2), and a third direction ($D_3$) perpendicular to the first and second directions ($D_1$, $D_2$) and the plane ($P_8$) of the strings. The bending rigidity of the shaft (6) in the third direction ($D_3$) is greater than its bending rigidity in the second direction ($D_2$).

12 Claims, 3 Drawing Sheets

BADMINTON RACKET

FIELD OF THE INVENTION

The invention relates to a badminton racket.

BACKGROUND OF THE INVENTION

In the field of racket sports, in particular for badminton, the flexibility of a shaft makes it possible to impart a certain power to a racket, i.e., to allow it to impact a shuttlecock to transmit relatively significant kinetic energy to it. On the contrary, rigidity of the shaft allows a precise hit, in particular in finalizing a shot.

The known rackets use both the flexibility and the rigidity of a connecting shaft between the handle and frame to try to obtain a relatively high power and precision. This compromise approach is not completely satisfactory, inasmuch as neither the power nor the precision are optimized.

SUMMARY OF THE INVENTION

Some rackets use shafts with an oval section elongated in a direction parallel to the strings of the racket. This geometry is presumed to improve the torsional stability of the racket, but tends to decrease its bending rigidity in a direction perpendicular to the strings, i.e., in the direction along which the strings hit the shuttlecock. This causes a precision flaw of the racket.

The invention more particularly aims to resolve these drawbacks by proposing a new racket that makes it possible to obtain an improved power and striking precision relative to the rackets of the state of the art.

To that end, the invention relates to a badminton racket that comprises a frame, a handle and a shaft connecting the frame to the handle, said racket defining a first direction parallel to a longitudinal axis of the shaft, a second direction perpendicular to the first direction and parallel to a plane in which strings extend mounted in the frame, and a third direction perpendicular to the first and second directions and the plane of the strings. According to the invention, the bending rigidity of the shaft in the third direction is greater than its bending rigidity in the second direction.

Owing to the invention, the differentiated bending rigidity of the shaft in the second and third directions makes it possible, when the user winds up his shot, to cause the shaft to bend elastically and to store the energy in the shaft in the second direction. This energy is retransmitted to the shuttlecock when the hit occurs, which takes place by moving the racket globally in the third direction. The power of the racket is improved by the relatively low bending rigidity of the shaft in the second direction. The precision of the racket is not deteriorated, as the bending rigidity in the third direction is relatively high.

According to advantageous but optional aspects of the invention, a racket according to the invention may incorporate one or more of the following features, in any technically allowable combination thereof:

- The shaft has a circular outer shape in transverse section.
- The shaft has an elongated outer shape in transverse section, with its largest dimension parallel to the third direction.
- The shaft is hollow and the wall thickness in the third direction is greater than its wall thickness in the second direction.

- A central hollow volume of the shaft has an elongated contour in transverse section, with its largest dimension parallel to the second direction.
- The component material of the shaft is homogenous around the longitudinal axis of the shaft.
- The shaft is equipped with means for locally reinforcing its bending rigidity in the third direction.
- The reinforcing means are aligned in the third direction.
- The reinforcing means are fixed on the outside or inside of the shaft.
- The reinforcing means are formed by bands containing carbon fibers.

BRIEF DESCRIPTION OF THE DRAWINGS

The invention will be better understood, and other advantages thereof will appear more clearly, in light of the following description of three embodiments of a racket according to its principle, provided solely as an example and done in reference to the appended drawings, in which.

DETAILED DESCRIPTION OF THE INVENTION

Figure 1:
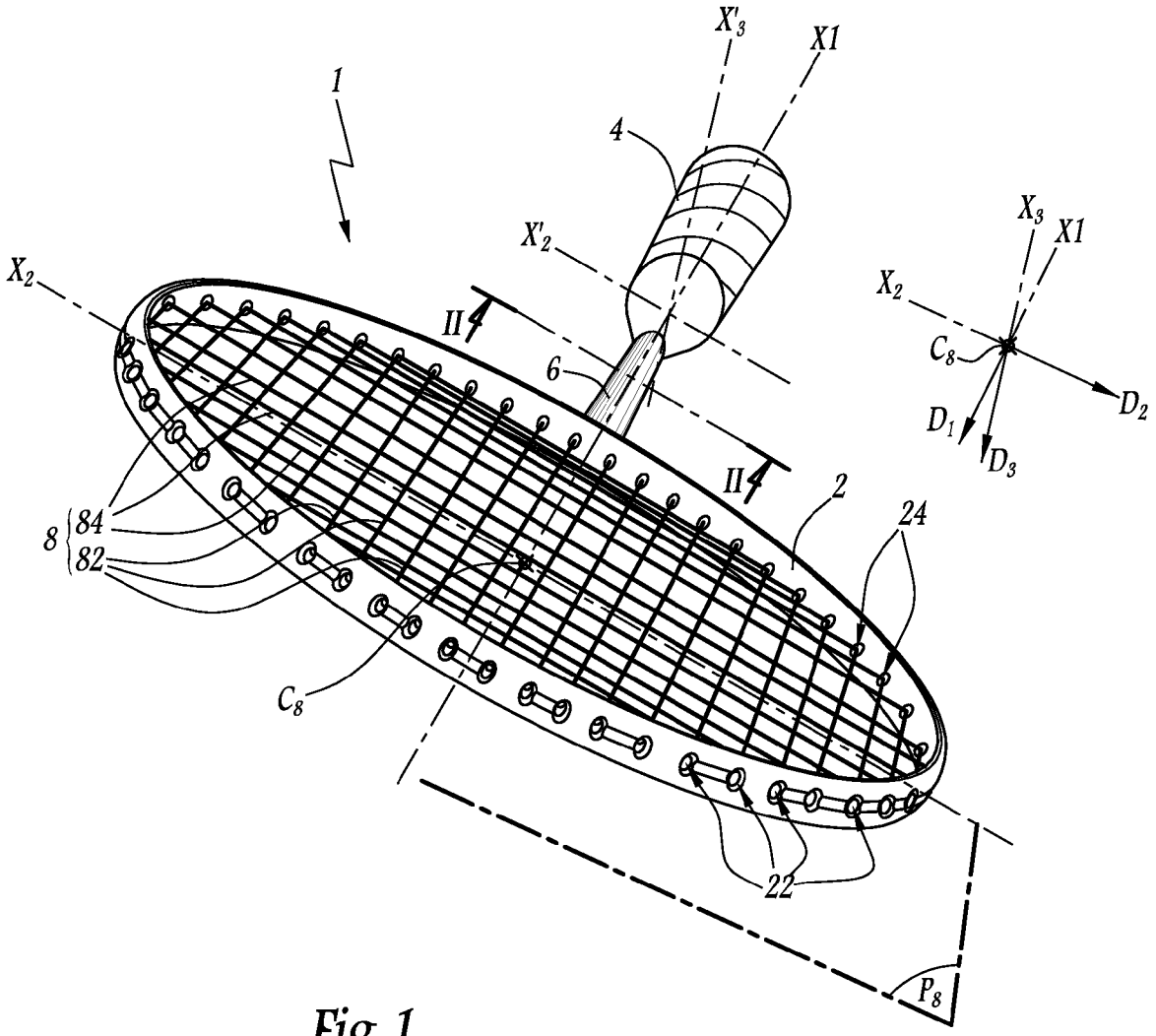
FIG. 1 is a perspective view of a racket according to a first embodiment of the invention.
Figure 2:
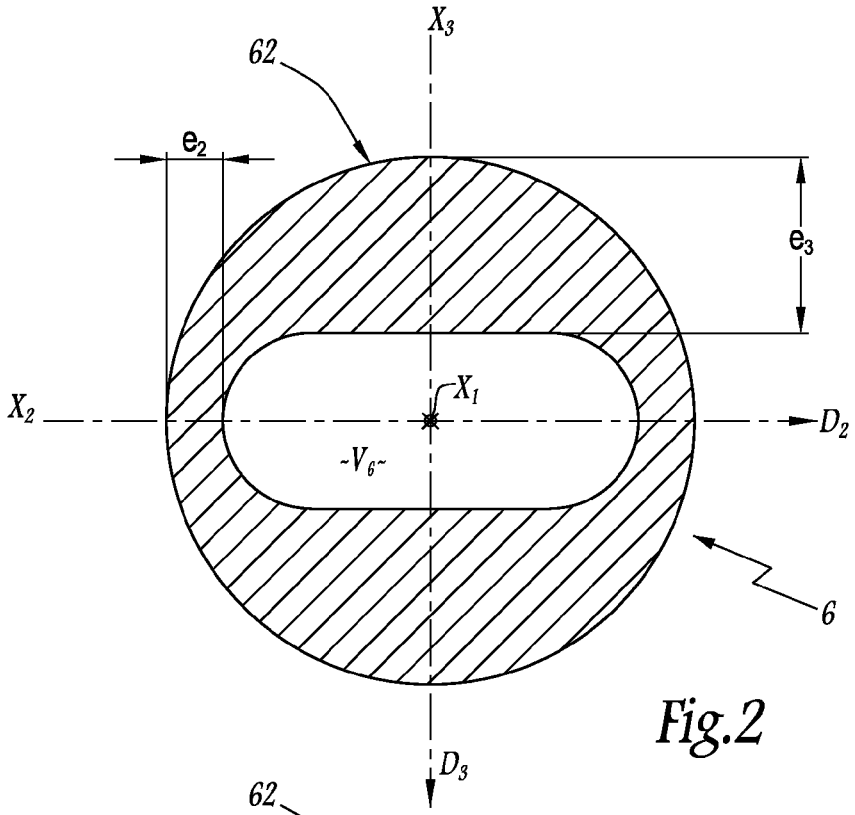
FIG. 2 is an enlarged cross-section along line II-II of FIG. 1.

The racket 1 shown in FIGS. 1 and 2 comprises a frame 2 in the form of a closed loop and a handle 4 intended to be held by a user. A shaft 6 connects the handle 4 to the frame 2 and extends along the longitudinal axis $X_1$, which constitutes a longitudinal axis of the racket 1. Strings 8 are mounted in the frame 2. The strings 8 are made up of longitudinal cords 82 that extend parallel to the axis $X_1$ and transverse cords 84 that extend perpendicular to the axis. The cords 82 and 84 pass through eyelets 22 positioned in orifices 24 that pass all the way through the frame 2, from its outer surface to its inner surface.

$P_8$ denotes the plane of the strings 8, i.e., a plane containing both the cords 82 and 84.

$X_2$ denotes an axis contained in the plane $P_8$ perpendicular to the axis $X_1$ and passing through the geometric center $C_8$ of the strings 8. The axis $X_2$ is a transverse axis for the racket 1.

Furthermore, $X_3$ denotes an axis perpendicular to the plane $P_8$, therefore the axes $X_1$ and $X_2$, and passing through the center $C_8$. For clarity of the drawing, in FIG. 1 the axis $X_3$ is only shown on a geometric reference drawn next to the racket. It may be qualified as a frontal axis, in that it defines the normal hit direction of the racket 1.

$D_1$ denotes a direction parallel to the axis $X_1$ and going from the handle 4 toward the frame 2, $D_2$ a direction parallel to the axis $X_2$ and going from left to right in FIG. 1, and $D_3$ a direction parallel to the axis $X_3$ and going from top to bottom in FIG. 1, respectively. $D_2$ is a lateral direction for the racket 1, while direction $D_3$ is a frontal direction.

As shown more particularly in FIG. 2, the shaft 6 comprises a circular outer radial surface 62 centered on the axis $X_1$. The circular nature of the surface 62 imparts a satisfactory aesthetic appearance to the racket 1, irrespective of the viewing angle.

The shaft 6 is hollow, and $V_6$ denotes its inner volume, which has an oval section, with its largest dimension aligned on the axis $X_2$.

The component material of the shaft 6 comprises a polymer resin in which reinforcing fibers are embedded, for example made from carbon. This material is homogenous around the axis $X_1$.

The shaft 6 is tubular and its thickness varies around the axis $X_1$. More specifically, in light of the geometry of the surface 62 and the volume $V_6$, the wall thickness $e_2$ of the shaft 6 in the direction $D_2$ is smaller than the wall thickness $e_3$ of the shaft in the direction $D_3$. Thus, the shaft 6 has a differentiated bending rigidity in directions $D_2$ and $D_3$. More specifically, considering that the shaft 6 is embedded in the handle 4, a bending movement of the shaft 6 in the direction $D_2$ may be considered a rotational movement around an axis $X'_3$ parallel to the axis $X_3$ and passing through the embedding point of the shaft 6 in the handle 4. Likewise, a bending movement in the direction $D_3$ may be considered a rotation around an axis $X'_2$ parallel to the axis $X_2$ and passing through an embedding point of the shaft 6 in the handle 4.

In light of the cross-sectional geometry of the shaft 6, the latter is more flexible in direction $D_2$ than in direction $D_3$.

When a user winds up for his blow, he moves the racket 1 in a direction of travel, while the plane $P_8$ is globally parallel to that direction of travel. Under these conditions, in light of the relatively significant flexibility of the shaft 6 in the direction $D_2$, the shaft 6 bends elastically and stores energy. When the user is about to hit the shuttlecock, he turns the racket a quarter revolution around the axis $X_1$, which results in bringing the direction $D_3$ in the direction of movement of the racket 1. Under these conditions, when the racket strikes the shuttlecock, it is relatively rigid, i.e., more rigid than in direction $D_2$. As a result, even if the shaft 6 restores the stored energy elastically during the first part of the movement, the precision of the shot is good, since the racket is rigid enough in direction $D_3$.

This differentiated bending behavior of the shaft 6 in directions $D_2$ and $D_3$ results from the difference between the thicknesses $e_2$ and $e_3$.

Figure 3:
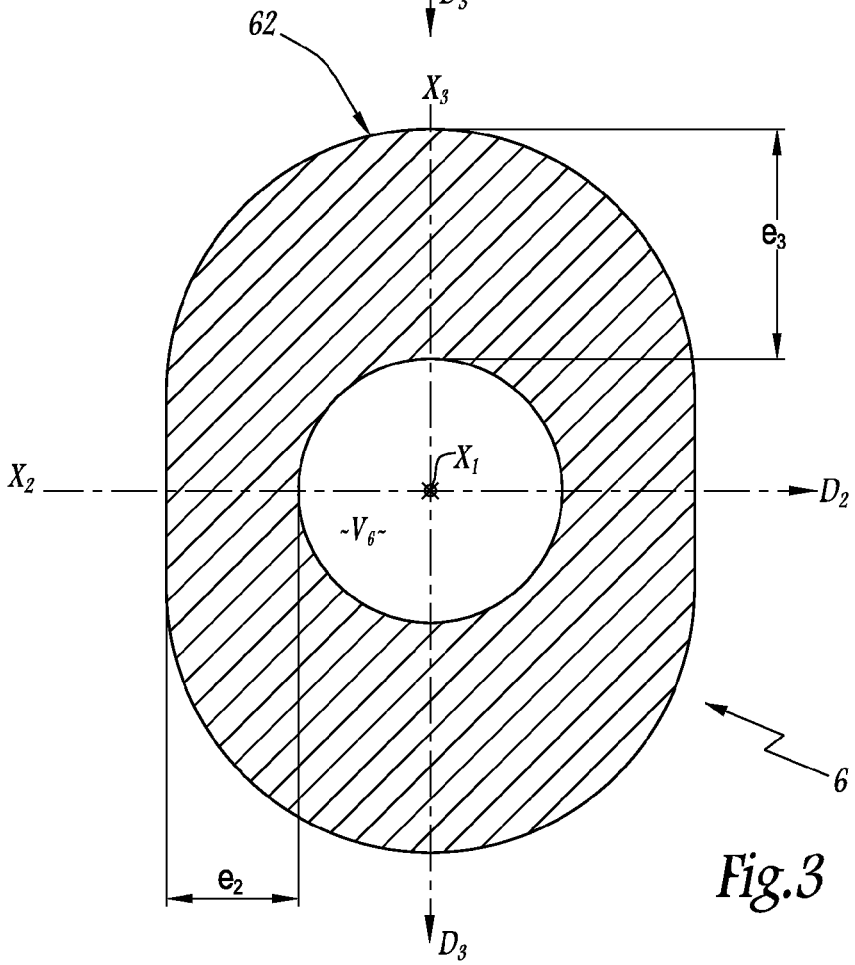
FIG. 3 is a cross-section similar to FIG. 2, for a racket according to a second embodiment of the invention.
Figure 4:
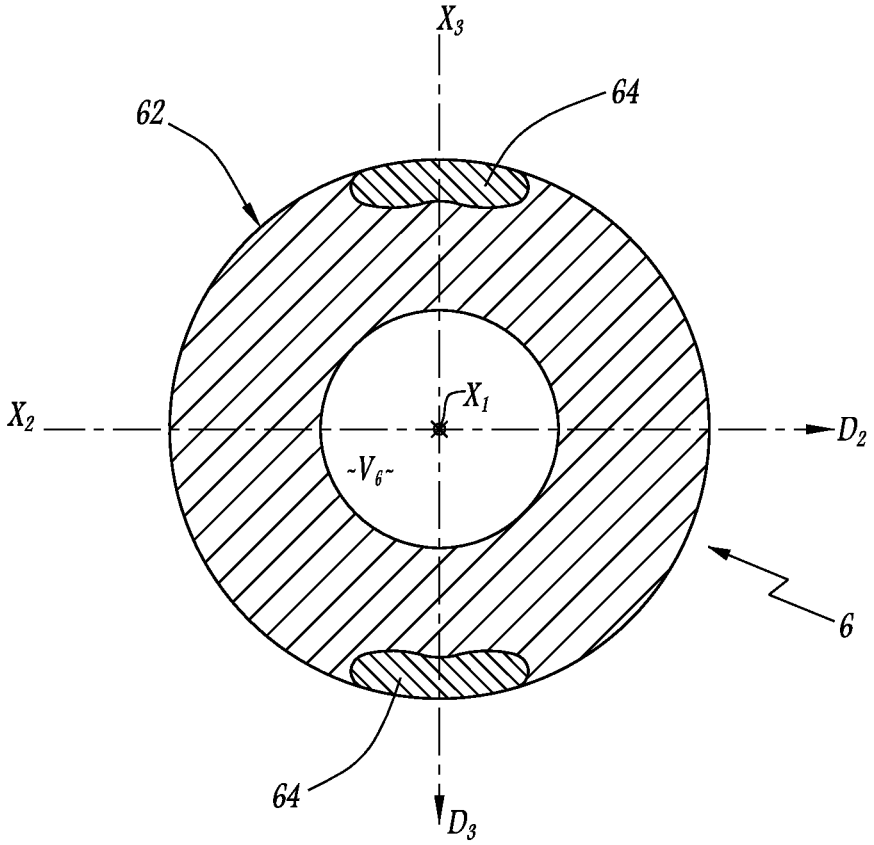
FIG. 4 is a cross-section similar to FIG. 2, for a racket according to a third embodiment of the invention.

In the second and third embodiments of the invention shown in FIGS. 3 and 4, the elements similar to those of the first embodiment bear the same references. Hereafter, we will only describe what distinguishes these embodiments from the first.

In the second embodiment, the outer radial surface 62 of the shaft 6 has a non-circular section, in this case oval, with its largest dimension oriented along the direction $D_3$. The volume $V_6$ has a circular section. Thus, the wall thickness $e_2$ of the shaft 6 in direction $D_2$ is smaller than the wall thickness $e_3$ in direction $D_3$.

In the third embodiment, the outer radial surface 62 of the shaft 6 has a circular section as well as volume $V_6$. Two reinforcements 64 are integrated into the shaft 6 and extend near the surface 62, i.e., on the outside thereof, while being aligned in direction $D_3$.

These reinforcements 64 may be produced by bands containing carbon fibers, optionally impregnated with resin, with a carbon fiber density that varies based on the desired difference in rigidity. Thus, the elements 64 make it possible to reinforce the bending rigidity of the shaft 6 locally, in direction $D_3$, since they are aligned in that direction.

In direction $D_2$, the reinforcements 64 have little impact on the bending behavior of the shaft 6, since they are subject to displacements, and therefore stresses lower than those to which they are subjected during bending along $D_3$.

The invention is not limited to the described embodiments. Thus, the volume $D_6$ of the first embodiment may have a section other than oval, for example polygonal. Likewise, the surface 62 may have a section other than oval in FIG. 3, for example polygonal.

The orientation of the directions $D_1$, $D_2$ and $D_3$ along the axes $X_1$, $X_2$ and $X_3$ is given as an example and may be reversed.

According to one alternative not shown, the reinforcements 64 may also be affixed to the inside of the shaft.

The features of the embodiments and alternatives considered above may be combined with each other.

The invention claimed is:

1. A badminton racket comprising a frame, a handle and a shaft connecting the frame to the handle, said racket defining:

a first direction parallel to a longitudinal axis of the shaft, a second direction perpendicular to the first direction and parallel to a plane in which strings extend mounted in the frame, and a third direction perpendicular to the first and second directions and the plane of the strings, wherein the bending rigidity of the shaft in the third direction is greater than its bending rigidity in the second direction, wherein the shaft is hollow and the wall thickness in the third direction is greater than its wall thickness in the second direction, and wherein the shaft has a circular outer shape in transverse section and wherein a central hollow volume of the shaft has an elongated contour in transverse section, with its largest dimension parallel to the second direction.

2. The racket according to claim 1, wherein the component material of the shaft is homogenous around the longitudinal axis of the shaft.

3. A badminton racket comprising a frame, a handle and a shaft connecting the frame to the handle, said racket defining:

a first direction parallel to a longitudinal axis of the shaft, a second direction perpendicular to the first direction and parallel to a plane in which strings extend mounted in the frame, and a third direction perpendicular to the first and second directions and the plane of the strings, wherein the bending rigidity of the shaft in the third direction is greater than its bending rigidity in the second direction, and wherein the shaft is equipped with means for locally reinforcing its bending rigidity in the third direction.

4. The racket according to claim 3, wherein the reinforcing means are aligned in the third direction.

5. The racket according to claim 3, wherein the reinforcing means are fixed on the outside or inside of the shaft.

6. The racket according to claim 3, wherein the reinforcing means are formed by bands containing carbon fibers.

7. The racket according to claim 3, wherein the shaft has a circular outer shape in transverse section.

8. The racket according to claim 3, wherein the shaft is hollow and the wall thickness in the third direction is greater than its wall thickness in the second direction.

9. The racket according to claim 3, wherein the shaft has a circular outer shape in transverse section and wherein a central hollow volume of the shaft has an elongated contour in transverse section, with its largest dimension parallel to the second direction.

10. The racket according to claim 3, wherein the component material of the shaft is homogenous around the longitudinal axis of the shaft.

11. The racket according to claim 3, wherein the shaft has an elongated outer shape in transverse section, with its largest dimension parallel to the third direction.

12. The racket according to claim 3, wherein the component material of the shaft is homogenous around the longitudinal axis of the shaft.

* * * * *